US008528539B2

(12) United States Patent
Xia

(10) Patent No.: US 8,528,539 B2
(45) Date of Patent: Sep. 10, 2013

(54) INTEGRATED STOVE IN WHICH OIL SMOKE IS DISCHARGED DOWNWARD

(75) Inventor: Zhisheng Xia, Haining (CN)

(73) Assignee: Zhejiang Meida Industrial Co., Ltd., Haining, Zhejiang Province (CN)

( * ) Notice: Subject to any disclaimer, the term of this patent is extended or adjusted under 35 U.S.C. 154(b) by 566 days.

(21) Appl. No.: 12/746,560

(22) PCT Filed: Apr. 28, 2008

(86) PCT No.: PCT/CN2008/070825

§ 371 (c)(1),
(2), (4) Date: Jun. 7, 2010

(87) PCT Pub. No.: WO2009/074026

PCT Pub. Date: Jun. 18, 2009

(65) Prior Publication Data

US 2010/0242945 A1 Sep. 30, 2010

(30) Foreign Application Priority Data

Dec. 7, 2007 (CN) ..... 2007 1 0164564

(51) Int. Cl.
*F24C 15/20* (2006.01)
*A47B 37/00* (2006.01)

(52) U.S. Cl.
USPC ..... 126/299 D; 126/299 R; 126/299 F; 108/50.13

(58) Field of Classification Search
USPC ..... 126/299 D, 299 R, 299 F; 108/50.13
See application file for complete search history.

(56) References Cited

U.S. PATENT DOCUMENTS

| | | | | |
|---|---|---|---|---|
| 3,724,441 | A * | 4/1973 | Finley | 126/38 |
| 2006/0150965 | A1 | 7/2006 | Kim et al. | |

FOREIGN PATENT DOCUMENTS

| | | | |
|---|---|---|---|
| CN | 2540578 | Y | 3/2003 |
| CN | 2550672 | Y | 5/2003 |
| CN | 2847105 | Y | 12/2006 |
| CN | 2898669 | Y | 5/2007 |
| CN | 200949871 | Y | 9/2007 |
| JP | 2003033278 | A * | 2/2003 |
| JP | 2004141206 | A | 5/2004 |

* cited by examiner

*Primary Examiner* — Kenneth Rinehart
*Assistant Examiner* — William Corboy
(74) *Attorney, Agent, or Firm* — Jacobson Holman PLLC; Jiwen Chen

(57) ABSTRACT

An integrated stove in which oil smoke is discharged downward comprises a cabinet body; a plurality of cylindrical sunken stove holes are installed on the panel of the body; a cooker is installed on the soleplate of the stove holes; major arc shaped air suction ports are installed at the upper part of the wall of the stove holes; a handle hole is installed in one side of the stove holes facing person; a soleplate parallel to the panel basically is installed; the soleplate has a structure in the shape of pan bottom; and the part of the soleplate close to the side wall of the body extends to the combined part of the panel and the soleplate. The panel is mounted at the top of the side wall. The stove holes are embedded in the double-layer structure formed by the panel and the soleplate. The side wall of the stove holes is both connected with the panel and the soleplate in sealing way, the panel, the soleplate and the side wall of the stove holes are enclosed to form a communicated sealed gas collecting chamber. The air port of a blower is installed at the open hole of the soleplate, and an exhaust pipe is connected with the blower.

6 Claims, 3 Drawing Sheets

INTEGRATED STOVE IN WHICH OIL SMOKE IS DISCHARGED DOWNWARD

This is a U.S. national stage application under 35 U.S.C. 371 of PCT/CN2008/070825, filed on Apr. 28, 2008 and published in Chinese, claiming priority from Chinese Application No. 200710164564.9, filed Dec. 7, 2007.

(1) FIELD OF THE INVENTION

The invention relates to an integrated stove in which oil smoke is discharged downward.

(2) BACKGROUND OF THE INVENTION

The effect of range hood is relevant to the distance between an air suction port and a fume producing source. General range hoods are upward type and are installed above cooking utensils, and the distance between the air suction port and the fume producing source is 50 to 100 cm usually, thereby causing fume diffusion easily and influencing human health and environmental health. The integrative machine of downward fume exhausting cooker is a combination of cooker and cooking utensils, and is characterized in that the air suction port thereof is installed near the fume producing source of the cooking utensils, thereby shortening the distance of free diffusion of fume and increasing the absorption rate of fume. However, such range hood is still in the period of principle research and is not perfect in specifically realized structure; and particularly, a specifically combined structure of cooker, cooking utensils and cabinet never has a simple, practical and reliable solution since the arrangement of air flue is complicated, the occupying volume is large, the fume is easy to leak, and both the reliability and the maintainability are bad.

China Patent ZL02234971.5 discloses an integrative machine of downward fume exhausting cooker, but the document does not solve the communication problem of the gas-gathering cavities of a plurality of stove ports. Under the circumstance that a plurality of stove ports are installed, communicating pipes are needed arranging so that a plurality of gas-gathering tanks are communicated with the blower, thereby complicating the arrangement of air flue, increasing the possibility of fume leakage, causing blockage with fume easily, and reducing the whole reliability. Moreover, the blower is far away from the air suction ports and more turns are made so that the air loss is large and the exhausting effect is influenced. Finally, the complication of air flue further results in difficult cleaning and increased difficulty of removing fume crud.

(3) SUMMARY OF THE INVENTION

The invention solves the disadvantages of the existing integrated stove in which oil smoke is discharged downward such as complicated arrangement of air flue, bad reliability, difficult cleaning and bad suction effect, and provides an integrative machine of downward fume exhausting cooker with high reliability, easy manufacturing and maintenance, and good suction effect.

An integrated stove in which oil smoke is discharged downward in the invention comprises a cabinet body; a plurality of cylindrical sunken stove holes are installed on the panel of the body; a cooker is installed on the soleplate of the stove holes; major arc shaped air suction ports are installed at the upper part of the wall of the stove holes; and a handle hole is installed in one side of the stove holes facing person, the integrative stove is characterized in that: a soleplate parallel to the panel basically is installed; the soleplate has a seamless structure in the shape of pan bottom; and the part of the soleplate close to the side wall of the body extends to the combined part of the panel and the soleplate, the panel is mounted at the top of the side wall, the stove holes are embedded in the double-layer structure formed by the panel and the soleplate, the side wall of the stove holes is both connected with the panel and the soleplate in sealing way, the panel, the soleplate and the side wall of the stove holes are enclosed to form a communicated sealed gas collecting chamber, the air port of a blower is installed at the open hole of the soleplate, and an exhaust pipe is connected with the blower.

Further, the reverse side of the panel is attached with a barrier strip shading the combined part of the panel and the side wall.

Further, the cylindrical wall of the stove holes is locked with the annular flange of the soleplate, and the cylindrical wall is wrapped outside the flange.

Further, the periphery of the soleplate is provided with a turned-over edge, and the turned-over edge is mounted at the top of the side wall.

Further, the air inlet of the blower is installed in the middle of two strove holes.

Furthermore, the upper part of the wall of the stove holes is provided with positive pressure blowing ports, the blowing ports are opposite to the air suction ports, the blowing ports are obliquely downwards, and the blowing ports are connected with positive pressure wind sources via air pipes.

When in use, a huge negative pressure gas collecting chamber is formed between the panel and the soleplate; the air suction holes of each stove are all contained in the gas collecting chamber without special gas collecting chamber and connecting wind pipe; the structure of air flue is simplified; and the communication problem of the air suctions of a plurality of stove ports is also solved without installing connecting pipelines additionally. The air inlet of the blower is directly opened on the soleplate and the distance to the air suction holes is very short, thereby facilitating to strengthen the suction of the air suction ports. The gas-collecting tank and the air flue have regular and simple structures and are not easy to be blocked by oil stain, thereby having high reliability, easy manufacturing and maintenance, and eliminating fume crud conveniently.

The soleplate in the shape of pan bottom in the invention also has the effect of preventing oil leakage. Oil has very strong permeability, and can permeate common weld joints to cause oil leakage. The soleplate in the shape of pan bottom can be formed by integrated extending, thereby avoiding weld joints and strengthening the performance of preventing oil leakage.

Scorching fume is cooled quickly after entering the gas collecting chamber, and a great deal of oil drops are condensed on the wall of the gas collecting chamber. The existing gas collecting chamber is formed by welding stainless steel flat plates. Practice has proved that oil has very strong permeability and can be permeated from micro-gaps of weld joints to cause oil leakage. The soleplate in the invention uses a structure in the shape of pan bottom and can be manufactured by extending a single plate, thereby avoiding weld joints and improving the performance of preventing oil leakage.

Simultaneously, the combined part of the panel which is mounted at the top of side wall and the soleplate is permeated easily by condensed oil of the gas-collecting tank; the oil drops can flow around after condensed at the reverse side of the panel and then the oil drops can flow down along the side wall; the main strategy of the existing gas-collecting tank is to improve welding precision; the cost is improved much, but the effect is not obvious; and practice has improved that welding defect is difficult to avoid. In the invention, the reverse side of the panel is attached with the barrier strip shading the combined part of the panel and the side wall, so that the oil drops are guided downwards by the barrier strip before they are able to flow to the combined part, and then the oil drops fall into the soleplate of the gas-collecting tank, thereby being capable of effectively preventing oil leakage from the combined part of the panel and the soleplate, and solving the difficult problem of oil leakage of the gas-collecting tank with low cost.

The structure with double layer plates further forms effective support for the stove holes. Therefore, the structure of air flue in the invention is very applied to an integrative machine of cooking utensils, cooker and cabinet.

The invention has the advantages of regular and simple structures of gas-collecting tank and air flue, good fume exhausting performance, not easy blockage with fume, high reliability, convenient unpicking and washing, easy manufacturing and maintenance, no oil leakage, compact whole structure, and good practicability.

(4) BRIEF DESCRIPTION OF THE DRAWINGS

(5) DETAILED DESCRIPTION OF THE INVENTION

Embodiment 1

Figure 2:
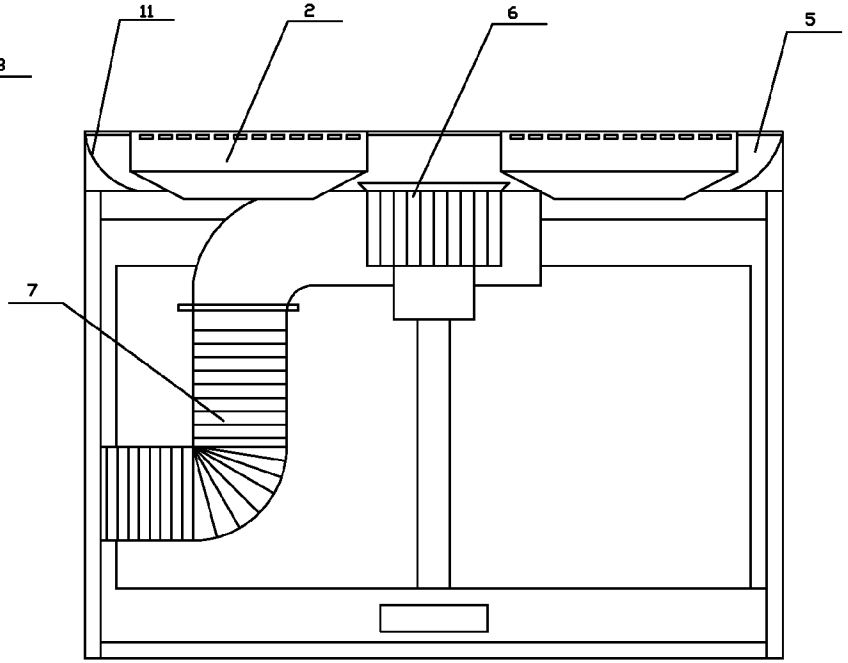
FIG. 2 is a schematic diagram of the invention.
Figure 1:
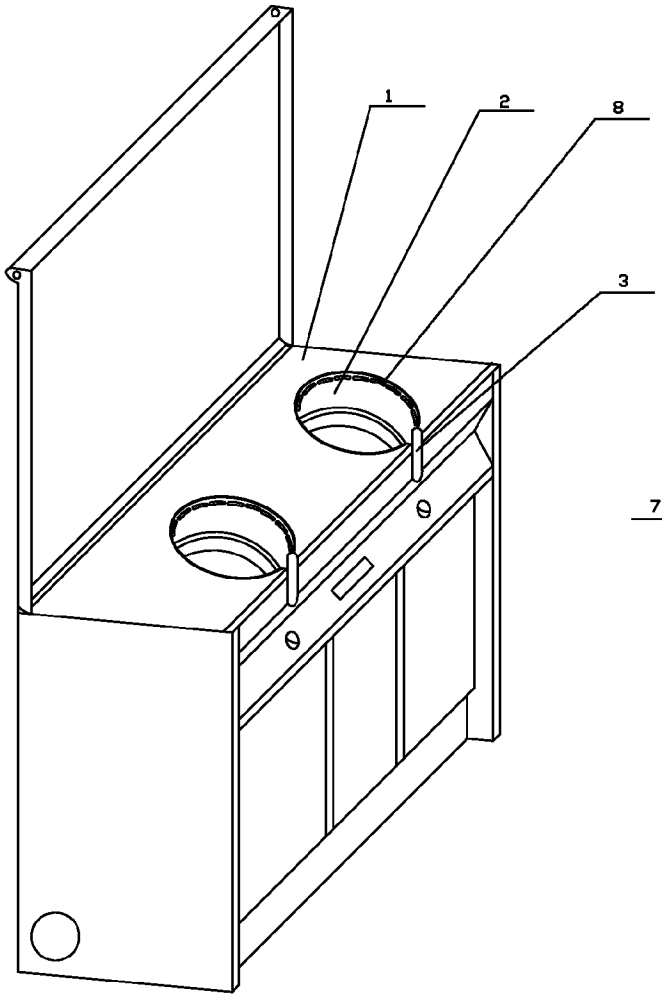
FIG. 1 is a stereogram of the invention.
Figure 3:
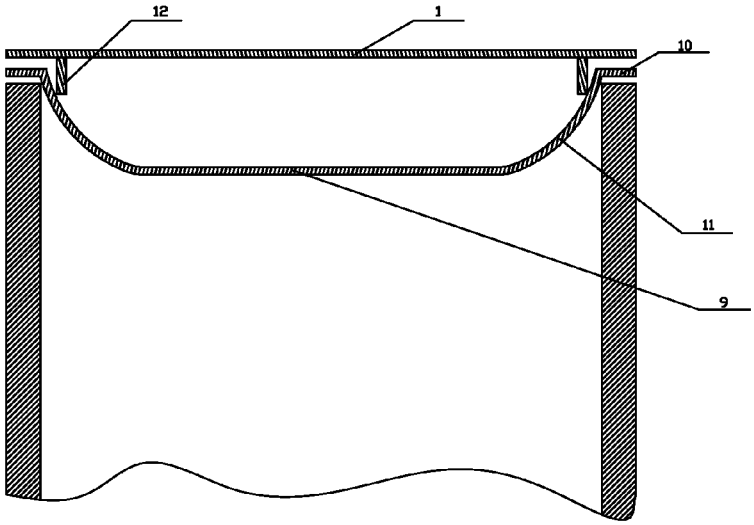
FIG. 3 is a schematic drawing of the associative relation of the panel, the soleplate and the side plate of the invention.
Figure 4:
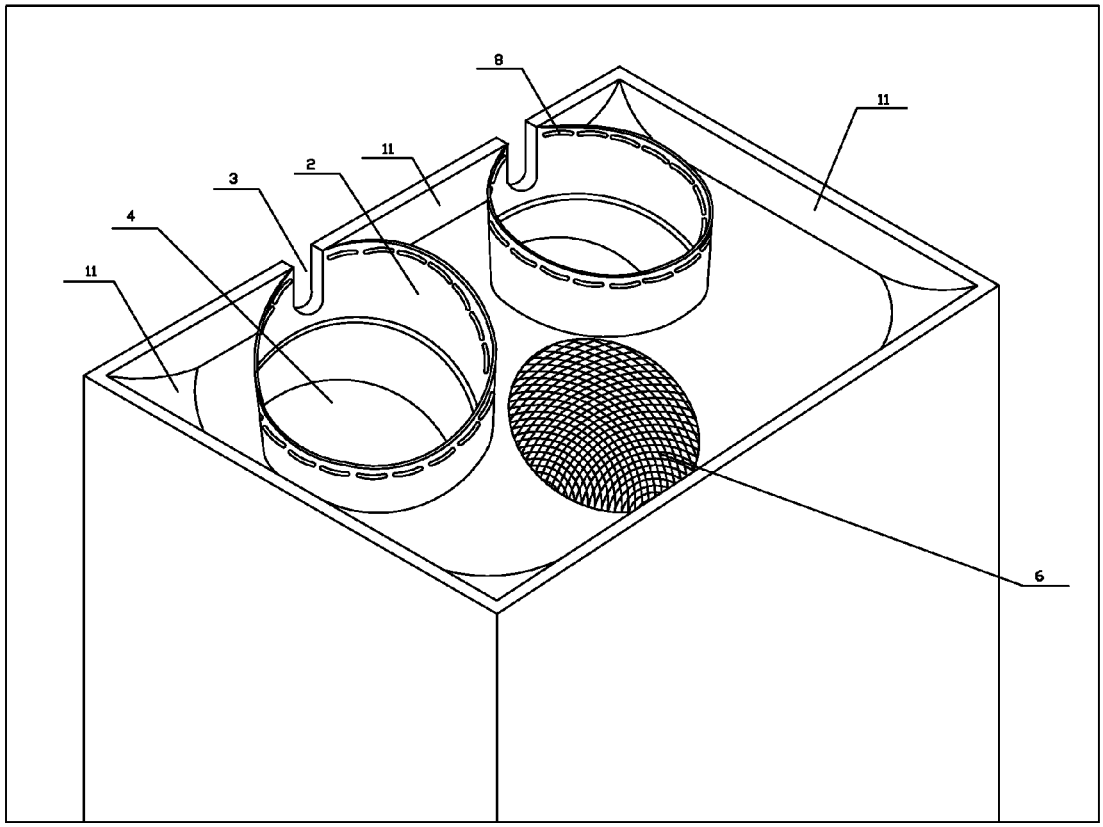
FIG. 4 is a stereogram of the invention after removing the panel.
Figure 5:
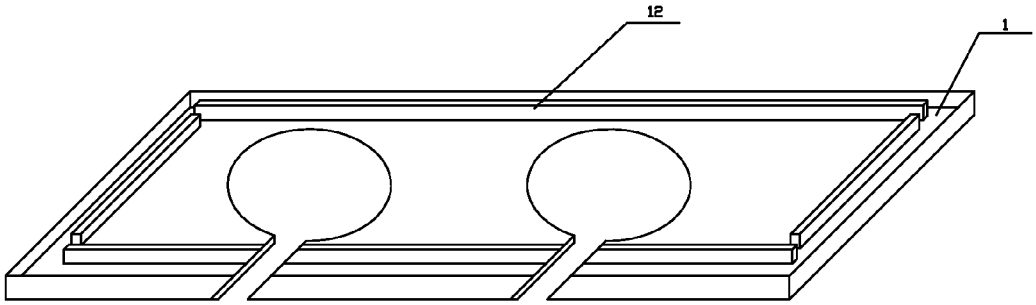
FIG. 5 is a schematic drawing of the soleplate of the panel.
Figure 6:
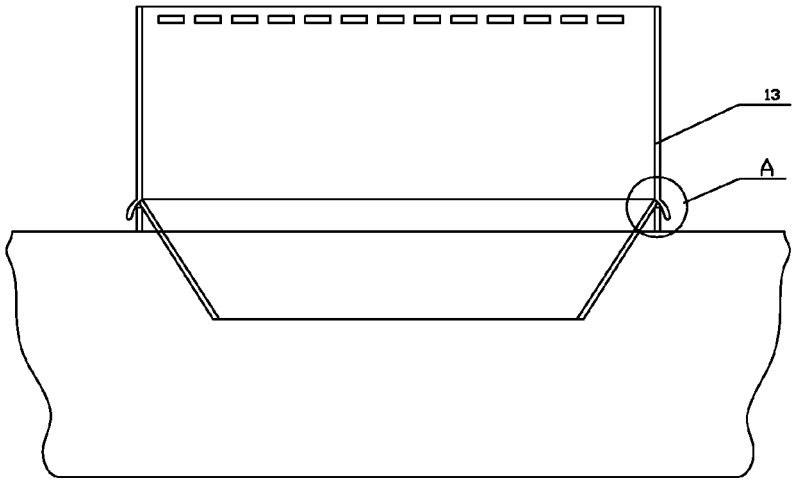
FIG. 6 is a schematic drawing of the connecting structure of the cylindrical wall of the stove holes and the annular flange of the soleplate.
Figure 7:
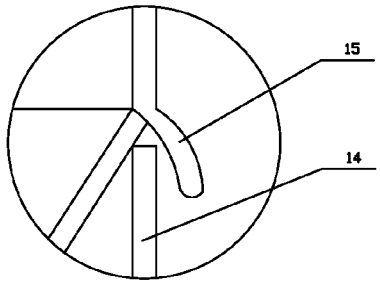
FIG. 7 is an enlarged drawing of A part in FIG. 6.

By reference to accompanying diagram 1-4:

The integrated stove in which oil smoke is discharged downward in the invention comprises a cabinet body; two cylindrical sunken stove holes 2 are installed on the panel 1 of the body; a cooker 4 is installed on the soleplate of the stove holes 2; major arc shaped air suction ports 8 are installed at the upper part of the wall of the stove holes 2; and a handle hole 3 is installed in one side of the stove holes 2 facing person.

A soleplate 9 parallel to the panel 1 basically is installed; the soleplate 9 has a seamless structure in the shape of pan bottom; and the part of the soleplate 9 close to the side wall of the body extends to the combined part of the panel 1 and the soleplate to form a curved transition part. The panel 1 is mounted at the top of the side wall. The stove holes 2 are embedded in the double-layer structure formed by the panel 1 and the soleplate 9. The side wall of the stove holes 2 is both connected with the panel 1 and the soleplate 9 in sealing way. The panel 1, the soleplate 9 and the side wall of the stove holes 2 are enclosed to form a communicated sealed gas collecting chamber. The air port of a blower 6 is installed at the open hole of the soleplate 9, and an exhaust pipe 7 is connected with the blower 6.

The periphery of the soleplate 9 is provided with a turned-over edge 10, and the turned-over edge 10 is mounted at the top of the side wall.

The air inlet of the blower 6 is installed in the middle of two strove holes.

When in use, a huge negative pressure gas collecting chamber is formed between the panel and the soleplate; the air suction holes of each stove are all contained in the gas collecting chamber without special gas collecting chamber and connecting wind pipe; the structure of air flue is simplified; and the communication problem of the air suctions of a plurality of stove ports is also solved without installing connecting pipelines additionally. The air inlet of the blower is directly opened on the soleplate and the distance to the air suction holes is very short, thereby facilitating to strengthen the suction of the air suction ports. The gas-collecting tank and the air flue have regular and simple structures and are not easy to be blocked by oil stain, thereby having high reliability, easy manufacturing and maintenance, and eliminating fume crud conveniently.

Scorching fume is cooled quickly after entering the gas collecting chamber, and a great deal of oil drops are condensed on the wall of the gas collecting chamber. The existing gas collecting chamber is formed by welding stainless steel flat plates. Practice has proved that oil has very strong permeability and can be permeated from micro-gaps of weld joints to cause oil leakage. The soleplate in the invention uses a structure in the shape of pan bottom and can be manufactured by extending a single plate, thereby avoiding weld joints and improving the performance of preventing oil leakage.

The structure with double layer plates further forms effective support for the stove holes. Therefore, the structure of air flue in the invention is very applied to an integrative machine of cooking utensils, cooker and cabinet.

Embodiment 2

By reference to accompanying diagram 1-5:

The difference between the embodiment 2 and the embodiment 1 is that the reverse side of the panel 1 is attached with a barrier strip 12 shading the panel 1 and the combined part of the side plate and the turned-over edge 10.

The combined part of the panel at the top of side wall and the soleplate is permeated easily by condensed oil of the gas-collecting tank; the oil drops can flows around after condensed at the reverse side of the panel and then flows down along the side wall; the main strategy of the existing gas-collecting tank is to improve welding precision; the cost is improved much, but the effect is not obvious; and practice has improved that welding defect is difficult to avoid. In the invention, the reverse side of the panel is attached with the barrier strip shading the combined part of the panel and the side wall, and the oil drops are guided downwards by the barrier strip before they are able to flow to the combined part and then fall into the soleplate of the gas-collecting tank, thereby being capable of effectively preventing oil leakage from the combined part of the panel and the soleplate, and solving the difficult problem of oil leakage of the gas-collecting tank with low cost.

Embodiment 3

By reference to accompanying diagram 1-7:

The difference between the embodiment 3 and the embodiment 2 is that the following structure is added: the cylindrical wall 13 of the stove hole 2 is locked with the annular flange 14 of the soleplate 9, and the cylindrical wall 13 is wrapped outside the flange 14.

The cylindrical wall 13 of the stove holes 2 also can condense oil drops, and oil drops are also permeated easily if the joint of the cylindrical wall 13 of the stove holes 2 and the soleplate is exposed outside. The application of the structure of the embodiment can avoid the joint contacting the oil drops to prevent oil leakage.

Embodiment 4

By reference to accompanying diagram 1-7:

The difference between the embodiment 4 and the embodiment 3 is that blowing ports of the stove holes are added: the upper part of the wall of the stove holes 2 is provided with positive pressure blowing ports opposite to the air suction ports obliquely downwards, and the blowing ports are connected with positive pressure wind sources via air pipes.

The blowing ports are used in combination with the air suction ports, thereby facilitating to form a fluid enveloping surface above the fume producing source and increasing the absorption rate of fume.

The invention claimed is:

1. An integrated stove in which oil smoke is discharged downward comprising a cabinet body, wherein a plurality of cylindrical sunken stove holes are installed on a top panel of the cabinet body; a cooker is installed on a bottom plate of the stove holes; major arc shaped air suction ports are installed at an upper part of a side wall of the stove holes; and a handle hole is installed in one side of the stove holes facing person;

wherein a soleplate parallel to the top panel is installed; the soleplate has a structure in the shape of pan bottom; and a part of the soleplate close to a side wall of the cabinet body extends to a joint section of the top panel and the soleplate, the top panel is mounted at the top of the side wall of the cabinet body, the stove holes are embedded in a double-layer structure formed by the top panel and the soleplate, the side wall of the stove holes is connected with both the top panel and the soleplate in sealing way; the top panel, the soleplate and the side wall of the stove holes are enclosed to form a communicated sealed gas collecting chamber, an air port of a blower is installed at an open hole of the soleplate, and an exhaust pipe is connected with the blower;

wherein a reverse side of the top panel facing the soleplate is attached with a barrier strip shading the joint section of the panel and the side wall of the cabinet to prevent oil from flowing to the joint section and permeating the joint section; and wherein the barrier strip is located within the sealed gas collection chamber.

2. The integrated stove in which oil smoke is discharged downward according to claim 1, wherein the side wall of the stove holes is a cylindrical wall and the cylindrical wall of the stove holes is locked with an annular flange of the soleplate, and the cylindrical wall is wrapped outside the annular flange.

3. The integrated stove in which oil smoke is discharged downward according to claim 1, characterized in that a periphery of the soleplate is provided with a turned-over edge, and the turned-over edge is mounted at the top of the side wall of the cabinet body.

4. The integrated stove in which oil smoke is discharged downward according to claim 3, wherein there are two stove holes and the air port of the blower is installed in the middle of two stove holes.

5. The integrated stove in which oil smoke is discharged downward according to claim 1, wherein the joint section of the top panel and the side wall of the cabinet body is connected by welding.

6. The integrated stove in which oil smoke is discharged downward according to claim 1, wherein the soleplate is made from extending a single piece of plate without welding joints.

* * * * *